US007392590B2

(12) United States Patent
Gordon

(10) Patent No.: US 7,392,590 B2
(45) Date of Patent: Jul. 1, 2008

(54) ARCHERY SIGHT AND RELATED METHOD

(76) Inventor: Sean E. Gordon, 3173 W. Feliciano Way, Tucson, AZ (US) 85742

( * ) Notice: Subject to any disclaimer, the term of this patent is extended or adjusted under 35 U.S.C. 154(b) by 12 days.

(21) Appl. No.: 11/484,194

(22) Filed: Jul. 11, 2006

(65) Prior Publication Data

US 2008/0010841 A1 Jan. 17, 2008

(51) Int. Cl.
*F41G 1/467* (2006.01)

(52) U.S. Cl. ..... 33/265; 124/87

(58) Field of Classification Search ..... 33/265; 124/86, 87, 88

See application file for complete search history.

(56) References Cited

U.S. PATENT DOCUMENTS

| | | | | |
|---|---|---|---|---|
| 495,296 | A | 4/1893 | Boynton | |
| 4,020,560 | A | 5/1977 | Heck | |
| 4,543,728 | A | 10/1985 | Kowalski | |
| 4,669,196 | A | 6/1987 | Kersey | |
| 4,995,166 | A | 2/1991 | Knemeyer | |
| 5,072,716 | A | 12/1991 | Sappington | |
| 5,228,204 | A | 7/1993 | Khoshnood | |
| 5,239,760 | A | 8/1993 | Dixon et al. | |
| 5,337,627 | A | 8/1994 | Nakamura | |
| 5,373,754 | A | 12/1994 | Takei | |
| 5,676,122 | A | 10/1997 | Wiseby et al. | |
| 6,397,482 | B1 | 6/2002 | Chipman | |
| 6,564,462 | B1 | 5/2003 | Henry | |
| 6,732,727 | B1 * | 5/2004 | Gallops, Jr. | 124/87 |
| 7,100,291 | B2 * | 9/2006 | Afshari | 33/265 |
| 2004/0006879 | A1 * | 1/2004 | Afshari | 33/265 |
| 2004/0107587 | A1 * | 6/2004 | Floied et al. | 33/265 |
| 2006/0011189 | A1 * | 1/2006 | Simo et al. | 124/86 |
| 2006/0283028 | A1 * | 12/2006 | Afshari | 33/265 |

* cited by examiner

*Primary Examiner*—G. Bradley Bennett
(74) *Attorney, Agent, or Firm*—Lawrence R. Oremland, P.C.

(57) ABSTRACT

A new and useful device and method is provided, for sighting an arrow being shot from a bow. A sight pin adjustment mechanism is associated with a plurality of sight pins, and is uniquely configured to be manipulated to simultaneously adjust each of the sight pins according to a predetermined trajectory formula that is at least partially related to the speed of an arrow as it leaves the bow. In one preferred form of the present invention, the sight includes an arrow speed calibration scale that is selectively moveable relative to an archery bow, and the plurality of sight pins are simultaneously moveable relative to the arrow speed calibration scale, and according to the predetermined trajectory formula. Also in a preferred form of the present invention, the sight pin adjustment mechanism comprises a shaft that is supported on the housing and has a plurality of lead screw portions, each of which is coupled with a respective sight pin. The pitch of each lead screw portion is determined according to the predetermined trajectory formula, to enable simultaneous adjustment of respective sight pins according to the predetermined trajectory formula.

25 Claims, 7 Drawing Sheets

ARCHERY SIGHT AND RELATED METHOD

BACKGROUND

The present invention relates to a new and useful device and method for sighting an arrow being shot from a bow, in a way that directs the arrow along a predetermined trajectory as the arrow is shot from the bow.

A typical archery bow sight comprises a plurality of sight pins that are used to enable an archer to sight an arrow that is being shot from the bow. In applicant's experience, it is conventional to support the sight pins individually on a housing, and to adjust the sight pins individually by providing test shots with the sight pins, and gauging the trajectory of an arrow shot with a particular sight pin, and then adjusting the sight pin if it is desired to adjust the trajectory of an arrow being shot with that sight pin.

Applicant believes there would be a benefit from a sight device that can provide simultaneous adjustment of all of the sight pins, and in a way that enables adjustment of the trajectory of an arrow that is shot using any sight pin, taking into account the speed of the arrow as it leaves the bow. Applicant believes there is a further benefit from a sight device that can be made relatively compact, so as to minimize the likelihood that the sight device would add an undesirable force/moment distribution to a bow.

SUMMARY OF THE INVENTION

The present invention provides a device and method for sighting an arrow being shot from a bow, in a way that simultaneously adjusts all of the sight pins connected with the bow, and in a way that is related to the trajectory and speed at which the arrow is shot from the bow.

In addition, the preferred version of sight of the present invention is designed to be relatively compact, and to minimize the type of force/moment distribution that the sight adds to a bow.

In an archery sight according to the present invention, a sight pin adjustment mechanism is associated with a plurality of sight pins, and is uniquely configured to be manipulated to simultaneously adjust each of the sight pins according to a predetermined trajectory formula that is at least partially related to the speed of an arrow as it leaves the bow.

In one preferred form of the present invention, the sight includes an arrow speed calibration scale that is selectively moveable relative to an archery bow, and the plurality of sight pins are simultaneously moveable relative to the arrow speed calibration scale, and according to the predetermined trajectory formula.

Also in a preferred form of the present invention, the sight pin adjustment mechanism comprises a shaft that is supported on the housing and has a plurality of lead screw portions, each of which is coupled with a respective sight pin. The pitch of each lead screw portion is determined according to the predetermined trajectory formula, to enable simultaneous adjustment of respective sight pins according to the predetermined trajectory formula.

Other features of the present invention will become further apparent from the following detailed description and the accompanying drawings.

BRIEF DESCRIPTION OF THE DRAWINGS AND EXHIBITS

Figure 1:
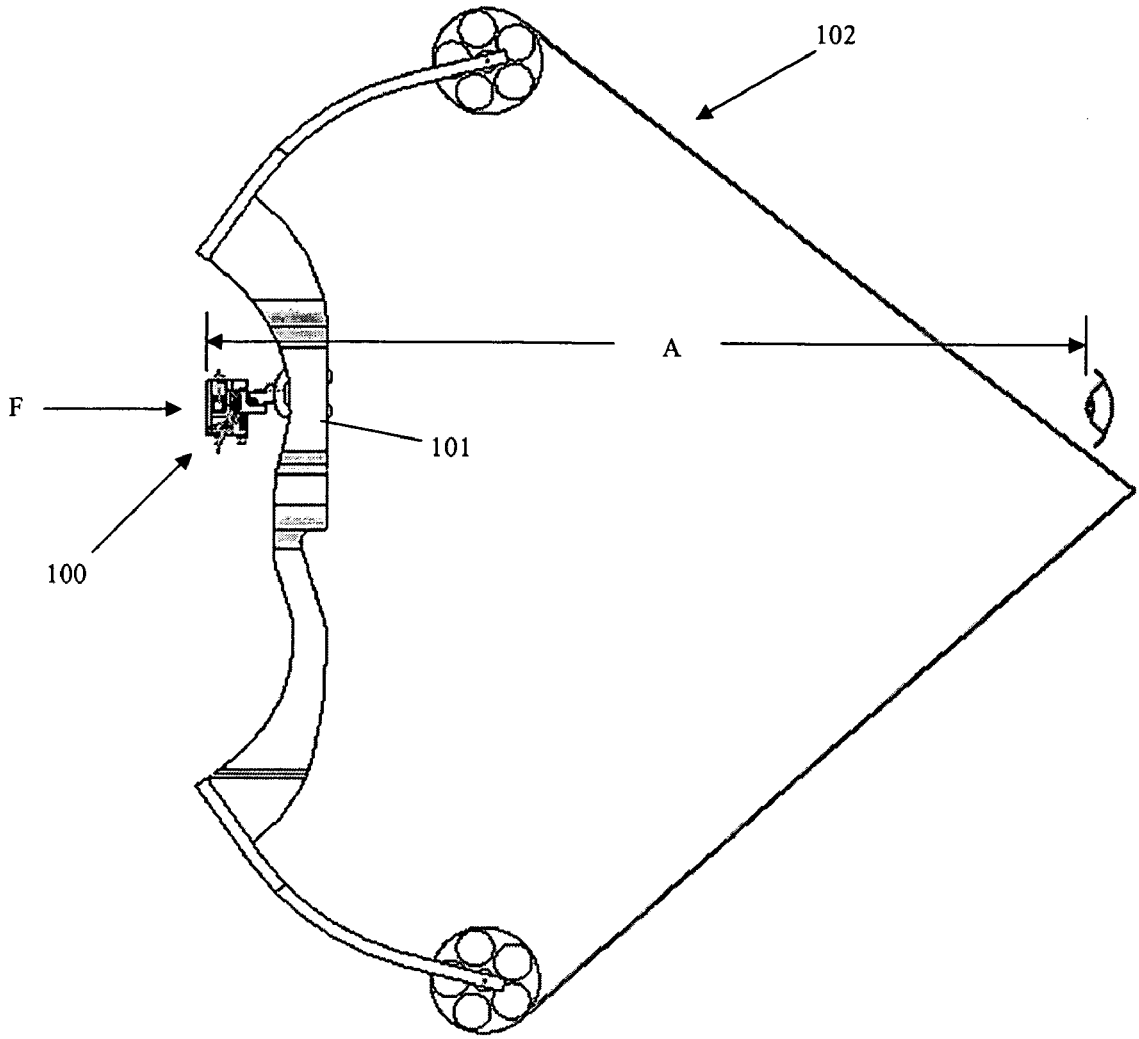
FIG. 1 is a schematic side illustration of an archery sight according to the present invention, attached to an archery bow, with the bow string pulled back to illustrate the manner in which the sight length is determined.
Figure 4:
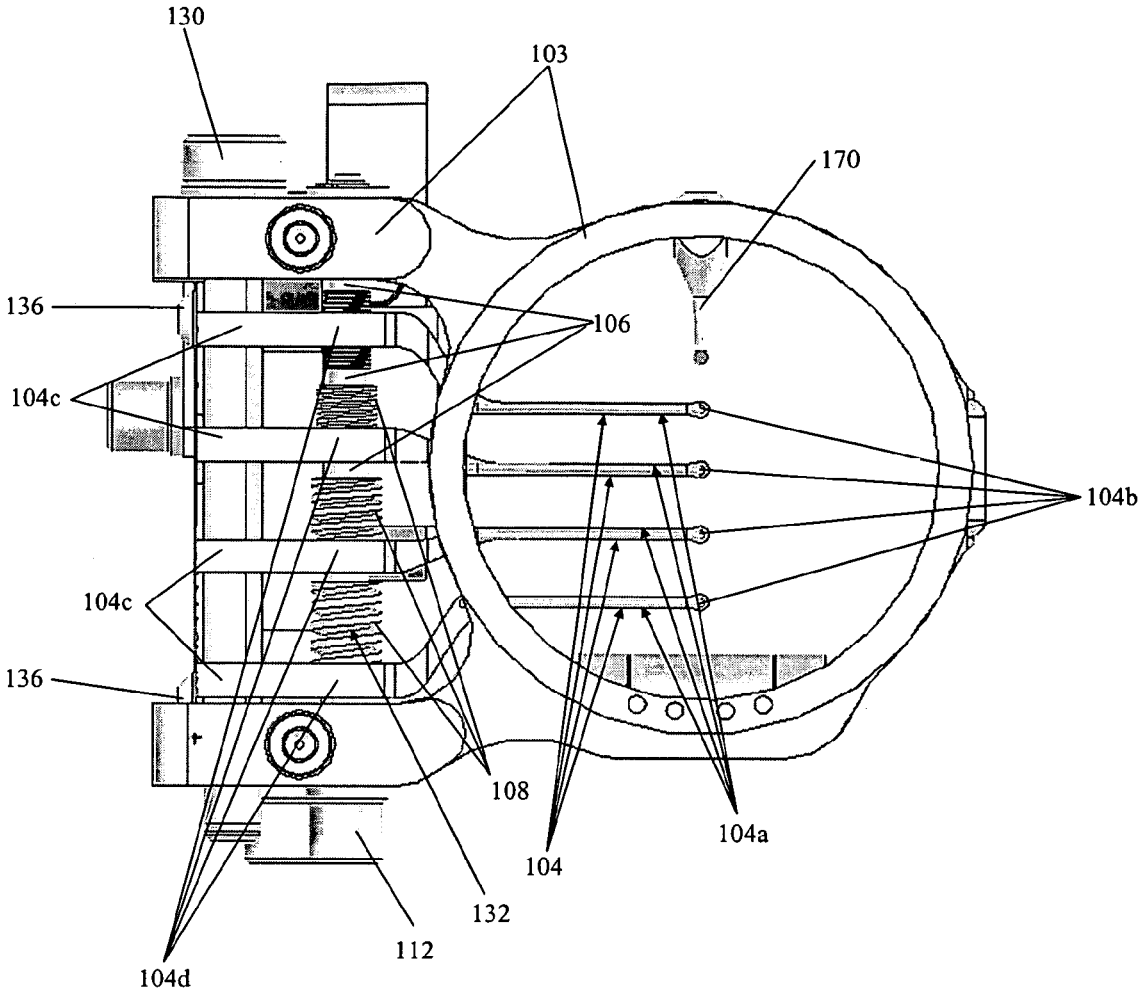
Figure 5:
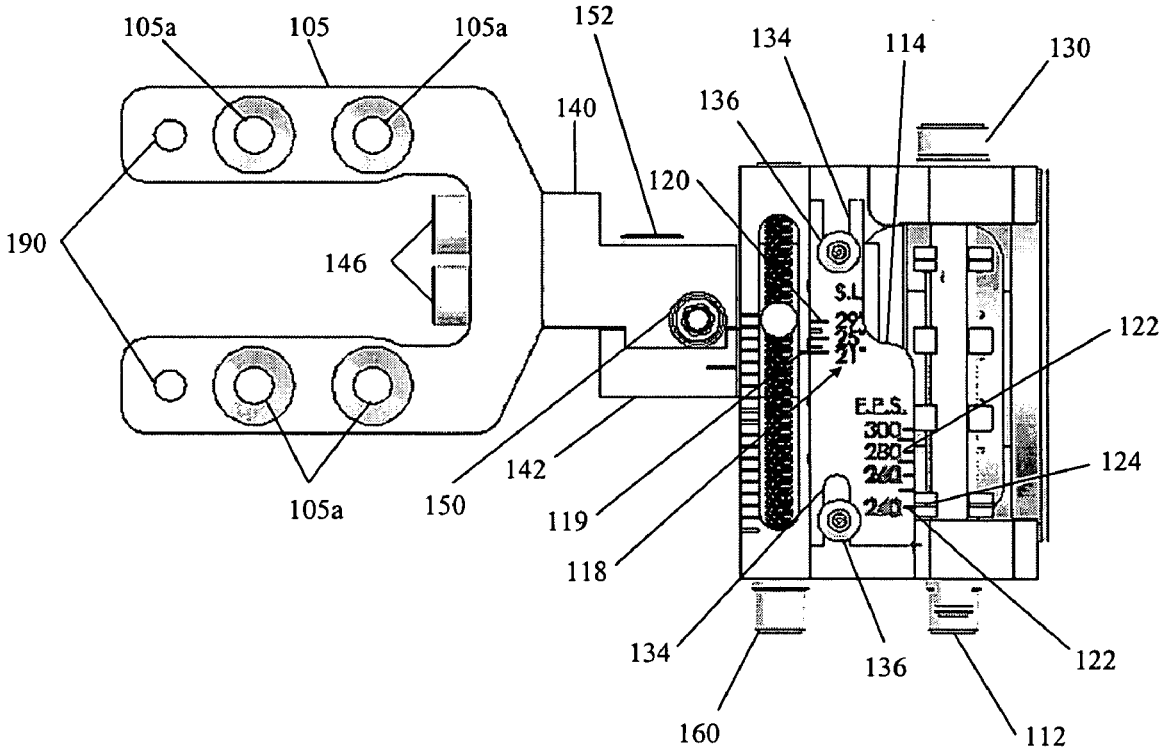
Figure 6:
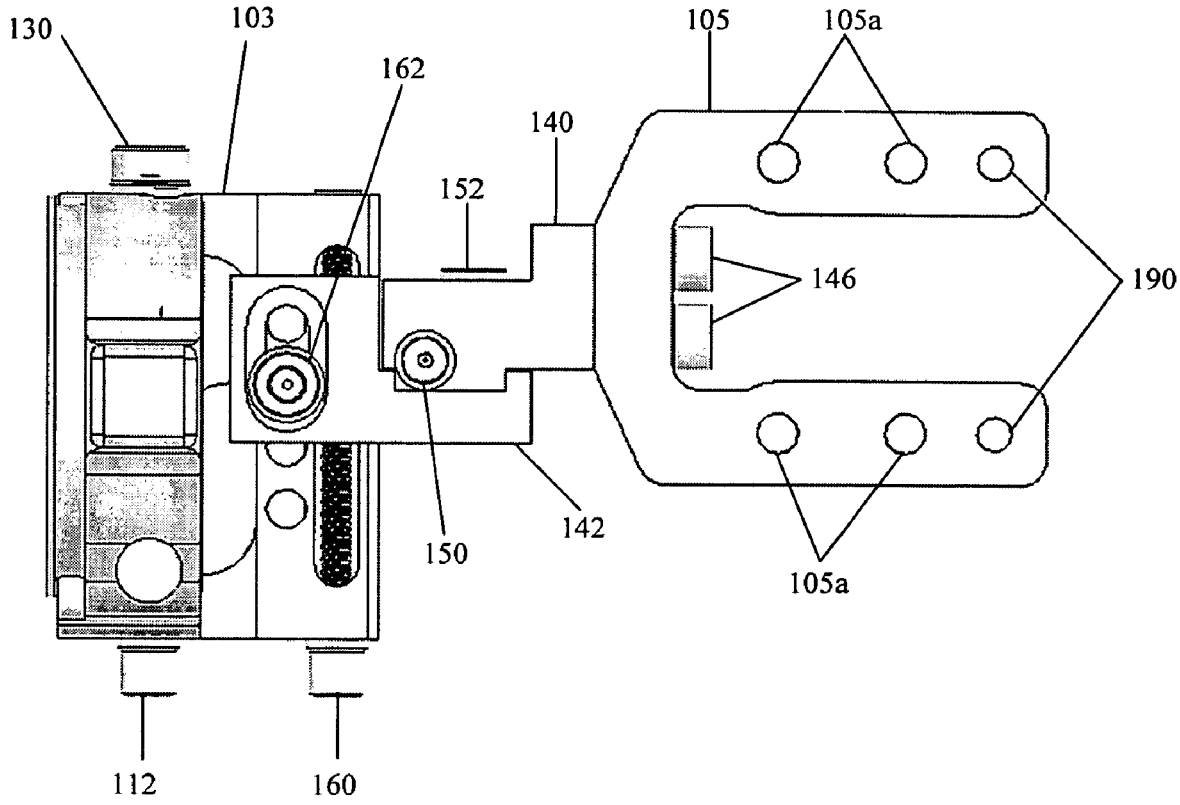
Figure 7:
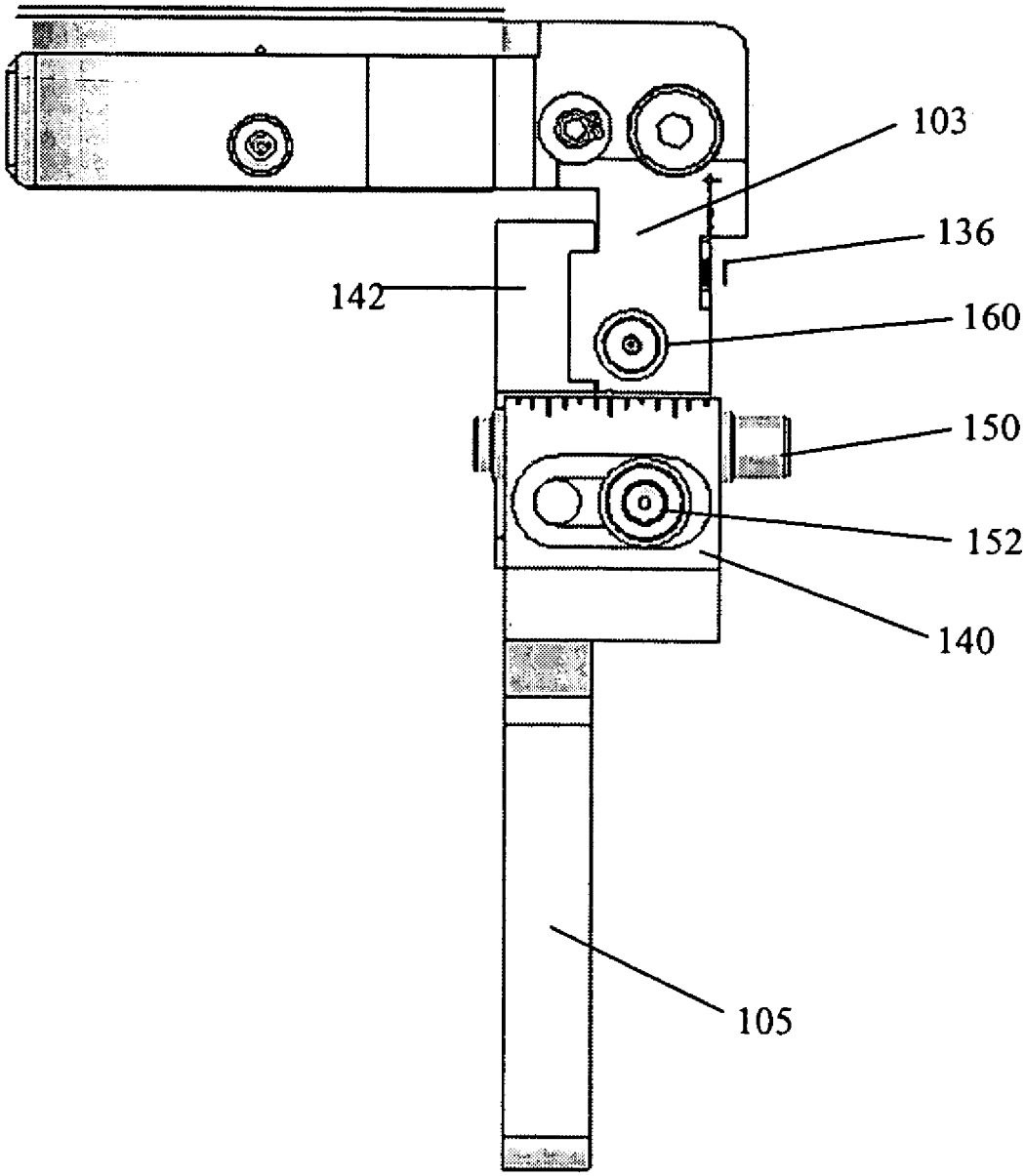

4 is front view of the archery sight of FIG. 1, taken from the direction F; and FIGS. 5-7 are left side, right side and top views, respectively, of the archery sight of the present invention, from orientations referenced to the front view of FIG. 4.

Figure 2:
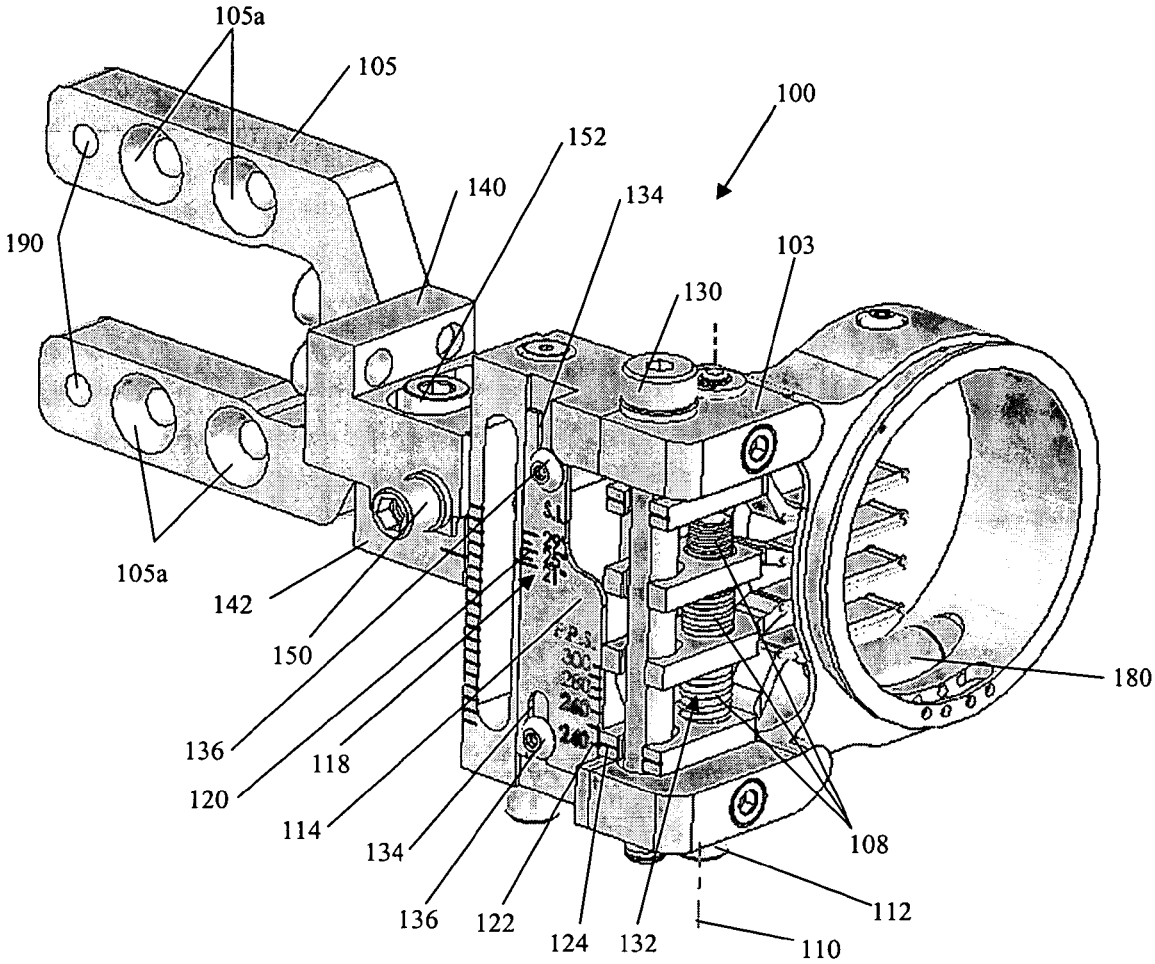
FIGS. 2 and 3 are three dimensional views of an archery sight according to the present invention, taken from the front and rear of the sight, respectively.
Figure 3:
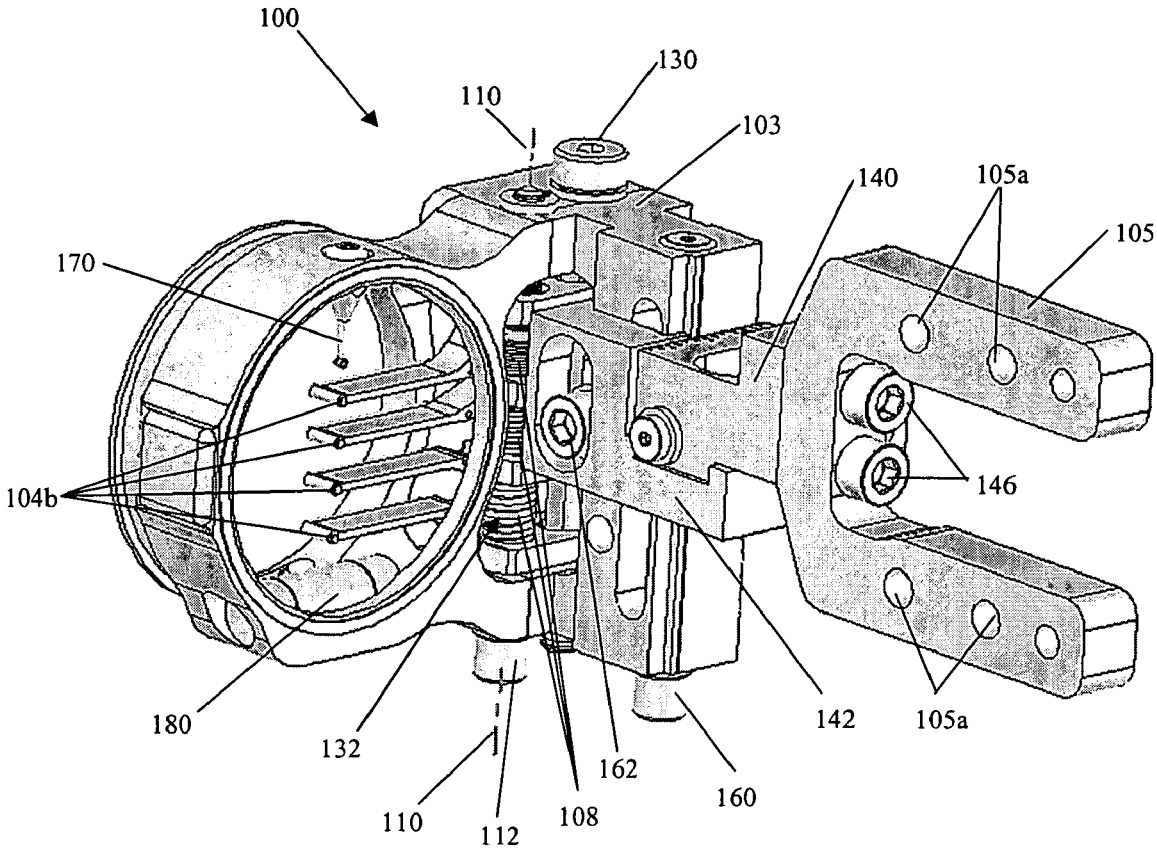

Exhibits A and B are color versions of FIGS. 2 and 3, respectively. While some components are shown in color in Exhibits A and B, and in grayscales in FIGS. 2 and 3, such color or grayscales are to better illustrate the components, but are not considered part of the present invention.

DETAILED DESCRIPTION

As discussed above, the present invention relates to a new and useful structure forming a sight device for an archery bow, and to a new and useful method for sighting an arrow being shot from an archery bow. The principles of the present invention are described below in connection with one exemplary embodiment of the structure and method of the present invention, and from that description the manner in which the principles of the present invention can be applied to various types of devices and arrow sighting techniques will be apparent to those in the art.

FIG. 1 shows a sight 100 that is constructed according to the present invention, secured to the handle 101 of an archery bow 102. As shown in FIGS. 2-7, the sight 100 includes a housing 103 and a plurality of sight pins 104 supported on the housing. Each sight pin 104 is oriented to enable an archer who sights with the pin to determine an arrow's departure angle toward a target. The sight 100 is connected to the handle 101 of the bow by means of a sight mount 105 that has sight mount holes 105*a* that can be aligned with tapped holes in the handle, to enable the sight to be attached to the handle (e.g. by screws).

Each of the sight pins 104 is coupled to a sight pin adjustment mechanism that is supported on the housing 103. The sight pin adjustment mechanism preferably comprises a multi pitch lead screw 132 comprising a shaft 106 with a plurality of lead screw portions 108 that can be formed monolithically in one piece with the shaft 106. The shaft 106 is supported on the housing in a manner that enables the shaft (and its lead screw portions 108) to rotate about a central axis 110. Each lead screw portion 108 is coupled with a respective sight pin 104. More specifically, each sight pin 104 has (i) a distal end 104*a* with a pin head 104*b* that is used by an archer to sight with the pin, and (ii) a proximal end 104*c* with a coupling flange 104*d* that fits onto a respective lead screw portion 108 (see FIG. 4). Each coupling flange 104*d* has a threaded opening that is engaged by a respective lead screw portion 108 so that when the shaft (and the lead screw portions) rotates about the central axis 110, each of the plurality of sight pins 104 moves along the central axis 110 to an extent determined by the shape of the sight pin and the pitch of the lead screw.

In FIG. 4, it should also be noted that the geometries of the sight pins 104 is preferably such that the top and bottom sight pins are bent to one extent between the proximal ends 104*c* and distal ends 104*a*, and the intermediate sight pins are bent to a different extent. This geometry is designed to optimize the maximum arrow speed range that can be provided by the sight, within a relatively compact sight package.

In accordance with the present invention, the pitch of each lead screw portion 108 is determined according to a predetermined trajectory formula that is designed to enable simultaneous adjustment of all of the sight pins (relative to the central axis 110) according to the predetermined trajectory formula when the shaft 106 rotates about the central axis 110. The principles by which the predetermined trajectory formula is determined and used in forming the respective pitches of the lead screw portions 108 is described below.

A knob 112 is coupled to an end of the shaft 106, and forms an actuator for the adjustment mechanism. The knob 112 can be manually rotated, to rotate the shaft 106 about the central axis 110. As described above when the shaft 106 rotates about the central axis 110, the plurality of sight pins 104 are simultaneously moved relative to the central axis 110 of the shaft in accordance with the predetermined trajectory formula. When the sight pins 104 are correctly positioned, a cam lock device 130 (see e.g. FIGS. 2, 3) can be rotated to lock the sight pins 104 in place. The cam lock device has a shaft with a diameter that is slightly larger than the hole it passes through in each sight pin. There are relief cuts in the sight pins and flats cut on the shaft to allow clearance between the shaft and sight pins when the cam lock is not engaged. When the cam lock is rotated 90 degrees it forces the diameter of the shaft to interfere with holes in the sight pins. This interference is what constrains the sight pins.

An arrow speed calibration scale 114 (FIGS. 2, 5) is supported on the housing 103, in such a manner that the arrow speed calibration scale 114 can be manually manipulated relative to the housing 103. Specifically, the arrow speed calibration scale 114 is configured as a plate that is mounted on the housing 103 in a manner such the arrow speed calibration scale can move linearly relative to the housing 103 by means of machined guide grooves 134 in the plate that slide along mounting screws 136. When the arrow speed calibration scale is in a predetermined position on the housing 103, the arrow speed calibration scale 114 can be maintained in that position by tightening the scale mounting screws.

The arrow speed calibration scale 114 is initially positioned on the housing 103 in accordance with a determination of the sight length of an archer using the bow, as described further below. Once the arrow speed calibration scale 114 has been positioned, the sight pin adjustment mechanism is moveable relative to the arrow speed calibration scale 114, in such a manner that a selected sight pin is positioned relative to the arrow speed calibration scale as the plurality of sight pins are being simultaneously adjusted. When that selected sight pin has been positioned relative to the arrow speed calibration scale, all of the sight pins 104 will be in appropriate positions relative to each other and to the arrow speed calibration scale, in accordance with the predetermined trajectory formula.

A sight length scale 118 is provided on a portion of the arrow speed calibration scale 114, so that the sight length scale 118 is moveable with the arrow speed calibration scale 114 relative to the housing 103 (FIGS. 2, 5). The housing 103 includes a sight length registration mark 119, and the sight length scale includes a plurality of sight length marks 120, each of which is associated with a respective sight length, and each of which can be selectively aligned with the sight length registration mark 119 on the housing, to position the sight length scale 118 and the arrow speed calibration scale 114 relative to the housing 103. The arrow speed calibration scale 114 includes a plurality of arrow speed reference marks 122, and a selected one of the sight pins 104 has an associated adjustment mark 124 which enables that sight pin to be aligned with the arrow speed calibration scale.

A gang adjustment mechanism is also provided for selectively adjusting the position of the housing 103 relative to a bow. Specifically, as shown in FIGS. 2-7, between the housing 103 and the sight mount 105 there is a horizontal slide block 140 and a vertical slide block 142. The horizontal slide block 140 is connected to the sight mount 105 by means of screws 146. The horizontal and vertical slide blocks are connected with each other, and with the housing 103 in such a manner that the horizontal slide block 142 can slide horizontally relative to sight mount 105, to move the housing 103 horizontally relative to the sight mount 105, and the vertical slide block 142 can slide vertically relative to the sight mount, to move the housing 103 vertically-relative to the sight mount 105. More specifically, the vertical slide block 142 has a member that engages a lead screw 160 that is supported by (and rotatable relative to) the housing, to enable the housing 103 and the vertical block 142 to move vertically relative to each other. Similarly, the vertical block 142 and the horizontal block 140 are interconnected in a similar manner, to enable those members to move horizontally relative to each other. In order to make a horizontal gang adjustment a horizontal lead screw 150 is turned to move the horizontal slide block 140 and pin housing 103 sideways (left and right) relative to the sight mount 105, and a screw 152 is tightened to lock the horizontal slide block 140 in place when the housing 103 has been adjusted sideways to a desired position. In order to make a vertical gang adjustment the vertical lead screw 160 is turned to move the pin housing 103 up or down relative to the sight mount 105, and a screw 162 is tightened to lock the vertical slide block 142 in place when the pin housing 103 has been moved to a desirable vertical position relative to the sight mount 105. The housing 103, the horizontal slide block 140, and the vertical slide block 142 have appropriate registration marks (see e.g. FIGS. 2, 5, 7) to assist in making gang adjustments. Thus, the gang adjustment enables the position of the housing 103 to be adjusted (in up and down and sideways directions) relative to the bow, without adjusting the relative positions of any of the sight pins 104 relative to the housing. Thus, once the plurality of sight pins have been adjusted with the sight pin adjustment mechanism, and the arrow trajectory has been set, it is not anticipated that there will be any further adjustment of the sight pins by the sight pin adjustment mechanism, but there may be a need to make a gang adjustment of the housing relative to the bow, if a test shot shows that the arrow direction can be improved with a gang adjustment of all of the sight pins.

In sighting an arrow, according to the principles of the present invention, initially the sight length and arrow speed are determined. Sight length is determined by physically measuring the distance from the archer's eye to the sight pins as the archer draws an arrow in the bow. In FIG. 1, that distance is schematically indicated by the reference letter A. Arrow speed can be determined in conventional ways, such as with a chronograph device (of conventional design) that records arrow speed as the arrow is shot from the bow. When the sight length is determined, the arrow speed calibration scale 114 is positioned relative to the housing 103 with a selected sight length mark 120 aligned with the sight length registration mark 119 on the housing. After the speed at which an arrow leaves the bow is determined, the selected sight pin is positioned so that the adjustment mark 124 associated with that sight pin is positioned in alignment with the arrow speed reference mark 122 on the arrow speed calibration scale 114 that most closely reflects the arrow speed that has been determined.

At that point all of the sight pins have been simultaneously positioned, according to the predetermined trajectory formula that is at least partially related to (i) the sight length and (ii) the speed of an arrow as it leaves the bow. Thus, the trajectory of an arrow that is being shot from the bow with any of the sight pins has been determined. However, it is possible that a further gang adjustment of the sight may be beneficial, to adjust the direction of an arrow that is being shot from the bow. To determine if such a gang adjustment is beneficial, a test shot at a target is conducted using a selected one of the sight pins. Depending on where the arrow hits the target (e.g. high, low, left or right of the primary target area), a determination is made as to whether a gang adjustment of the plurality of sight pins should be made based on the accuracy of the test shot, and if so making an appropriate gang adjustment of the plurality of sight pins.

It should be further noted that there is an additional sight pin 170 (FIGS. 3, 4) that is connected to the housing 103, and extends in a vertically downwardly position relative to the housing. That sight pin 170 is generally in a fixed position relative to the housing, in the sense that it is not adjusted along with the sight pins 104. The sight pin 170 is provided as an additional sight device, by which an archer can sight a test shot, in order to determine if a gang adjustment of the sight device may be beneficial. In addition, there is a bubble level device 180 coupled with the housing 103, in order to help align the sight device in an appropriate orientation during the aiming portion of the shot cycle. Still further, the sight mount may have tapped holes 190 that enable an accessory (e.g. an arrow quiver) to be mounted to the sight.

In determining the trajectory formula, and applying that trajectory formula to the design of the multi pitch lead screw portions, it is initially noted that the purpose of putting different pitch sections on the same lead screw is to allow objects to be moved relative to each other while maintaining constant proportional spacing. The pitch of a lead screw portion is equal to (1/(number of threads per inch). The distance an object travels that is threaded on to a particular lead screw portion is equal to the number of turns the lead screw portion is rotated multiplied by the pitch of that lead screw portion. For example, if a lead screw portion has 20 threads per inch (the thread makes 20 revolutions in a section 1-inch long) the pitch of that lead screw portion would equal 0.0500. If there was a nut threaded on the lead screw portion and the lead screw portion was rotated 3 turns the nut would move 0.150 inches relative to its' previous position. Having a multi pitch lead screw allows the objects threaded onto each lead screw portion of the multi pitch lead screw to be moved a different amount when the multi pitch lead screw is rotated. For example, if there is a multi pitch lead screw with 2 different pitch sections and an object attached to each of those sections and the pitch that one screw portion is threaded onto is 3 times the pitch that the other screw portion is threaded onto then when the multi pitch lead screw is rotated the one screw portion will travel 3 times the distance the other screw portion traveled. This principal allows objects that are governed by a liner equation to be positioned relative to each other.

The range equation (1) below is used to determine the distance a projectile will travel given the initial velocity of the projectile and departure angle.

$$R = \frac{v^2 \sin 2\phi}{g} \tag{1}$$

Where R=the distance the projectile travels, v=is initial velocity of the projectile, ϕ=the departure angle, and g is the acceleration of gravity. This equation can be expanded to account for aerodynamic drag that a projectile would see in practice.

The range equation can then be combined with the equation (2) below which relates departure angle to sight pin height, where (PH) is the height of the sight pin and (SL) is the linear distance from the archers' eye to the sight pin.

$$\phi = \sin\left(\frac{PH}{SL}\right)^{-1} \tag{2}$$

$$R = \frac{v^2 \sin\left(2\left[\sin\left(\frac{PH}{SL}\right)^{-1}\right]\right)}{g} \tag{3}$$

The foregoing equation (3) can then be solved and graphed for pin height as a function of initial arrow velocity. The equation can be simplified by assigning values to variables such as sight length and arrow weight. A linear approximation can then be taken for each value of the range. The change in velocity is the same for each sight pin when the lead screw is rotated so the following equation (4) can be derived.

$$\Delta v = \frac{\Delta PH_{30\,\mathrm{yd}}}{M_{30\,\mathrm{yd}}} = \frac{\Delta PH_{40\,\mathrm{yd}}}{M_{40\,\mathrm{yd}}} = \frac{\Delta PH_{50\,\mathrm{yd}}}{M_{50\,\mathrm{yd}}} \tag{4}$$

Where (M) is the slope of the equation that controls each sight pin. Since the pitch of the screw is equal to APH when the screw is rotated exactly 1 revolution, any pitch of any portion of the lead screw can be input and the following equation (5) can be used to solve for the remaining pitches.

$$\Delta PH_{30\,\mathrm{yd}} = \frac{\Delta PH_{40\,\mathrm{yd}} * M_{30\,\mathrm{yd}}}{M_{40\,\mathrm{yd}}} = \frac{\Delta PH_{50\,\mathrm{yd}} * M_{30\,\mathrm{yd}}}{M_{50\,\mathrm{yd}}} = \frac{\Delta PH_{60\,\mathrm{yd}} * M_{30\,\mathrm{yd}}}{M_{60\,\mathrm{yd}}} \tag{5}$$

Thus, the foregoing description provides a unique sighting device and method that enables an arrow to be directed along a predetermined trajectory as the arrow is being shot from a bow. With the foregoing disclosure in mind, it is believed that various ways of providing a device and method to enable an arrow to be directed along a predetermined trajectory as the arrow is being shot from a bow, according to the principles of the present invention, will be apparent to those in the art.

The invention claimed is:

1. An archery sight for attachment to an archery bow, comprising, a plurality of sight pins, each of which is oriented to enable an archer who sights with the pin to determine an arrow's departure angle toward a target, an arrow speed calibration scale, and a sight pin adjustment mechanism coupled with the plurality of sight pins;

the sight pin adjustment mechanism being moveable relative to the arrow speed calibration scale, and the plurality of sight pins coupled with the adjustment mechanism such that movement of the adjustment mechanism to position a selected sight pin relative to the arrow speed calibration scale simultaneously adjusts each of the plurality of sight pins according to a predetermined trajectory formula that is at least partially related to the speed of an arrow as it leaves the bow.

2. An archery sight as defined in claim 1, wherein the sight pin adjustment mechanism comprises a shaft with a plurality of lead screw portions, each of which is coupled with a respective sight pin, the pitch of each lead screw portion being determined according to the predetermined trajectory formula, to enable simultaneous adjustment of respective sight pins according to the predetermined trajectory formula.

3. An archery sight as defined in claim 2, wherein the shaft is rotatable about a central axis and an actuator is coupled with the shaft in a way such that turning the actuator rotates the shaft about its central axis.

4. An archery sight as defined in claim 1, wherein the sight pin adjustment mechanism is supported by a housing, and wherein the arrow speed calibration scale is selectively moveable relative to the housing to position the arrow speed calibration scale relative to the housing.

5. An archery sight as defined in claim 4, further including a sight length scale that is moveable with the arrow speed calibration scale relative to the housing.

6. An archery sight as defined in claim 5, wherein the housing includes a sight length registration mark, and the arrow speed calibration scale includes a plurality of sight length marks, each of which is associated with a respective sight length, and each of which can be selectively aligned with the sight length registration mark on the housing, to position the arrows speed calibration scale relative to the housing.

7. An archery sight as defined in claim 6, wherein the arrow speed calibration scale includes a plurality of arrow speed reference marks, and wherein a sight pin adjustment mark is associated with a selected sight pin and can be aligned with a selected arrow speed reference marks on the arrow speed calibration scale.

8. An archery sight for attachment to an archery bow, comprising, a plurality of sight pins, each of which is oriented to enable an archer who sights with the pin to determine an arrow's departure angle toward a target, a sight pin adjustment mechanism coupled with the plurality of sight pins, and the sight pin adjustment mechanism comprising a multi-pitch threaded shaft having a plurality of lead screw portions wherein at least two of said lead screw portions have different pitches, each of said lead portions being coupled with a respective sight pin, the pitch of each lead screw portion being determined according to the predetermined trajectory formula, to enable simultaneous adjustment of respective sight pins according to a predetermined trajectory formula that is at least partially related to the speed of an arrow as it leaves the bow.

9. An archery sight as defined in claim 8, further including a gang adjustment mechanism for selectively adjusting the position of the plurality of sight pins relative to a bow.

10. Apparatus comprising an archery bow with an attached sight for use in sighting an arrow being shot from the bow, the sight comprising, a plurality of sight pins, each of which is oriented to enable an archer who sights with the pin to determine an arrow's departure angle toward a target, an arrow speed calibration scale, and a sight pin adjustment mechanism coupled with the plurality of sight pins;

the sight pin adjustment mechanism being moveable relative to the arrow speed calibration scale, and the plurality of sight pins coupled with the adjustment mechanism such that movement of the adjustment mechanism to position a selected sight pin relative to the arrow speed calibration scale simultaneously moves each of the plurality of sight pins by different amounts according to a predetermined trajectory formula that is at least partially related to the speed of an arrow as it leaves the bow.

11. Apparatus as defined in claim 10, wherein the sight pin adjustment mechanism comprises a shaft with a plurality of lead screw portions wherein at least two of said lead screw portions have different pitches, each of said lead screw portions being coupled with a respective sight pin, the pitch of each lead screw portion being determined according to the predetermined trajectory formula, to enable simultaneous adjustment of respective sight pins according to the predetermined trajectory formula.

12. Apparatus as defined in claim 11, wherein the shaft is rotatable about a central axis and an actuator is coupled with the shaft in a way such that turning the actuator rotates the shaft about its central axis.

13. Apparatus as defined in claim 12, wherein the sight pin adjustment mechanism is supported by a housing, and wherein an arrow speed calibration scale is selectively moveable relative to the housing to position the arrow speed calibration scale relative to the housing.

14. Apparatus as defined in claim 13, further including a sight length scale that is moveable with the arrow speed calibration scale relative to the housing.

15. Apparatus as defined in claim 14, wherein the housing includes a sight length registration mark, and the arrow speed calibration scale includes a plurality of sight length marks, each of which is associated with a respective sight length, and each of which can be selectively aligned with the sight length registration mark on the housing, to position the arrows speed calibration scale relative to the housing.

16. Apparatus as defined in claim 15, wherein the arrow speed calibration scale includes a plurality of arrow speed reference marks, and wherein a sight pin adjustment mark is associated with a selected sight pin and can be aligned with a selected arrow speed reference marks on the arrow speed calibration scale.

17. Apparatus comprising an archery bow with an attached sight for use in sighting an arrow being shot from the bow, the sight comprising, a plurality of sight pins, each of which is oriented to enable an archer who sights with the pin to determine an arrow's departure angle toward a target, a sight pin adjustment mechanism coupled with the plurality of sight pins, and the sight pin adjustment mechanism comprising a threaded shaft having a plurality of lead screw portions wherein at least two of said lead screw portions have different pitches, each of said lead screw portions being coupled with a respective sight pin, the pitch of each lead screw portion being determined according to a predetermined trajectory formula, to enable simultaneous adjustment of respective sight pins by different amounts according to the predetermined trajectory formula that is at least partially related to the speed of an arrow as it leaves the bow.

18. Apparatus as defined in claim 17, further including a gang adjustment mechanism for selectively adjusting the position of the plurality of sight pins relative to the bow.

19. A method of sighting an arrow, as the arrow is being shot toward a target by an archery bow, comprising the steps of determining the sight length for an arrow being shot from the bow, determining the speed at which an arrow leaves the bow as the arrow is shot from the bow, and simultaneously adjusting a plurality of sight pins by different amounts relative to the bow, according to a trajectory formula that is at least partially related to (i) the sight length and (ii) the speed of an arrow as it leaves the bow.

20. A method as set forth in claim 19, wherein a multi-pitch screw has a plurality of threaded portions, each of which is coupled with a respective one of the plurality of sight pins, and each of which is moveable relative to its respective sight pin to position the sight pin according to a predetermined trajectory formula, and the step of simultaneously adjusting the plurality of sight pins comprises moving the multi-pitch screw in a manner that simultaneously positions each of the plurality of sight pins according to the trajectory formula.

21. A method as set forth in claim 20, including the further step of providing a test shot by shooting an arrow toward a target using one of the sight pins, determining whether a gang adjustment of the plurality of sight pins should be made based on the accuracy of the test shoot, and selectively making a gang adjustment of the plurality of sight pins if the test shot determines that an adjustment should be made.

22. A method as set forth in claim 19, including the further step of providing a test shoot by shooting an arrow toward a target using one of the sight pins, determining whether a gang adjustment of the plurality of sight pins should be made based on the accuracy of the test shoot, and selectively making a gang adjustment of the plurality of sight pins if the test shot determines that an adjustment should be made.

23. A method as set forth in claim 19, wherein the sight pins are supported on housing, an arrow speed calibration scale is provided that is coupled with the housing in such a manner that the arrow speed calibration scale is selectively moveable relative to the housing prior to the step of simultaneously adjusting the plurality of sight pins, and wherein the step of simultaneously adjusting the plurality of sight pins comprises simultaneously adjusting the plurality of sight pins relative to the arrow speed calibration scale.

24. A method as defined in claim 23, wherein the arrow speed calibration scale has a plurality of arrow speed reference marks, and wherein a selected sight pin has an arrow speed registration mark associated with that pin, and wherein after the arrow speed is determined the sight pins are simultaneously adjusted by positioning the arrow speed registration mark relative to a selected arrow speed reference marks.

25. A method as defined in claim 24, wherein the housing is provided with a sight length registration mark and the arrow speed calibration scale is provided with has a plurality of sight length marks, and wherein after the sight length has been determined the arrow speed calibration scale is selectively moved relative to the housing to position a selected sight length mark on the arrow speed calibration scale in alignment with the sight length registration mark on the housing.

* * * * *